United States Patent [19]

Phillips

[11] Patent Number: 5,023,511

[45] Date of Patent: Jun. 11, 1991

[54] OPTICAL ELEMENT OUTPUT FOR AN IMAGE INTENSIFIER DEVICE

[75] Inventor: Earle N. Phillips, Roanoke, Va.

[73] Assignee: ITT Corporation, New York, N.Y.

[21] Appl. No.: 541,203

[22] Filed: Jun. 25, 1990

Related U.S. Application Data

[63] Continuation of Ser. No. 265,368, Oct. 27, 1988, abandoned.

[51] Int. Cl.[5] ..... H01J 40/16; H01J 31/50

[52] U.S. Cl. ..... 313/524; 313/526; 313/528; 313/530

[58] Field of Search ..... 313/524, 526, 525, 528, 313/530, 478

[56] References Cited

U.S. PATENT DOCUMENTS

| | | | |
|---|---|---|---|
| 2,093,288 | 9/1937 | Ogloblinsky | 313/478 X |
| 2,120,916 | 6/1938 | Bitner | 313/526 X |
| 2,506,018 | 5/1950 | Flory et al. | 313/524 |
| 3,708,673 | 1/1973 | Blacker, Jr. | 313/528 X |
| 3,974,376 | 8/1976 | Van der Sande | 313/524 X |
| 4,150,320 | 4/1979 | Mitchel et al. | 313/478 |
| 4,459,508 | 7/1984 | Ichikawa et al. | 313/530 X |
| 4,658,128 | 4/1987 | Beierlein | 313/525 X |

FOREIGN PATENT DOCUMENTS

| | | | |
|---|---|---|---|
| 0248342 | 11/1986 | Japan | 313/478 |

*Primary Examiner*—Palmer C. DeMeo

*Attorney, Agent, or Firm*—Arthur L. Plevy; Patrick M. Hogan

[57] ABSTRACT

An image intensifier tube having a photocathode, a microchannel plate and an anode. The anode includes a lens element with a phosphor screen deposited thereon as an output window. The lens element may take the form of either a plano-convex or plano-concave element and has either a spheric or aspheric curved surface. In a modified version a plano glass element is affixed to the plano surface of the lens element. Methods of forming the tube with the lens element are at the time the finished tube is assembled in the intensifier device or at the time the tube is constructed.

7 Claims, 1 Drawing Sheet

OPTICAL ELEMENT OUTPUT FOR AN IMAGE INTENSIFIER DEVICE

This application is a continuation of application Ser. No. 07/265,368 filed Oct. 27, 1988, and now abandoned.

BACKGROUND OF THE INVENTION

This invention relates to an electro-optical device and more particularly to an image intensifier tube and an optical arrangement for such a tube.

Image intensifier devices multiply the amount of incident light they receive and thus provide an increase in light output which can be supplied either to a camera or directly to the eyes of a viewer. These devices are particularly useful for providing images from dark regions and have both industrial and military application. For example, these devices are used for enhancing the night vision of aviators, for photographing astronomical bodies and for providing night vision to sufferers of retinitis pigmentosa (night blindness).

Modern image intensifier devices include three main components, namely a photocathode, a phosphor screen (anode) and a microchannel plate (MCP) positioned intermediate to the photocathode and anode. These components are housed in a tube. The photocathode is extremely sensitive to low-radiation levels of infrared light in the 580–900 nm (red) spectral range. The MCP is a thin glass plate having an array of microscopic holes through it. Each hole is capable of acting as a channel-type secondary emission electron multiplier. When the microchannel plate is placed in the plane of an electron image in an intensifier tube, one can achieve a gain of up to several thousand. Since each channel in a microchannel plate operates nearly independently of all the others, a bright point source of light will saturate a few channels but will not spread out over adjacent areas. This characteristic of "local saturation" makes these tubes more immune to blooming at bright areas.

The anode of the image intensifier tube includes an output window and a phosphor screen which is formed on one surface of the window. Known tubes have included the use of a flat glass window as an output screen for the image intensifier. However, the two parallel glass surfaces of the window cause reflections and ghost images which cannot be eliminated by the use of anti-reflective coatings. In order to overcome the reflection problem, a fiber optic output element is normally used instead of a flat glass output window.

The fiber optic window is comprised of a matrix of very thin core glass rods surrounded by a clad glass. It is a high cost component. In addition, approximately 35% of the surface area of the fiber optic window is blocked from receiving light due to the matrix construction. Thus, the performance of the device is degraded due mainly to the relatively low open or optically usable area of the fiber optic window, which is typically about 60%.

It is therefore an object of the present invention to provide an image intensifier device having a low reflection optical window.

It is an additional object of the present invention to provide a method of making such an output window in a highly economical and efficient manner.

These objects and others which will become apparent hereinafter are accomplished by the present invention which provides an image intensifier device including an input window formed of optical material and having light receiving and light transmitting surfaces; photoemissive means on the light transmitting surface for emitting electrons in response to light received at the photoemissive means; means positioned adjacent the photoemissive means for amplifying the number of electrons emitted from the photoemissive means; means positioned adjacent the amplifying means for converting the energy from the amplified electrons to light; and means for focusing the image received from the converting means.

The present invention also provides a method of making an image intensifier device including the steps of forming a cathode for receiving input light and emitting electrons in response to the received light; providing means for amplifying the number of electrons emitted from the cathode; positioning an anode adjacent the amplifying means for converting the amplified electrons to light rays; and placing an optical element adjacent the anode for converting the light rays to an image.

BRIEF DESCRIPTION OF THE DRAWING

The above-mentioned and other features and objects of this invention will become more apparent by reference to the following description taken in conjunction with the accompanying drawing in which.

DETAILED DESCRIPTION OF THE INVENTION

Figure 1:
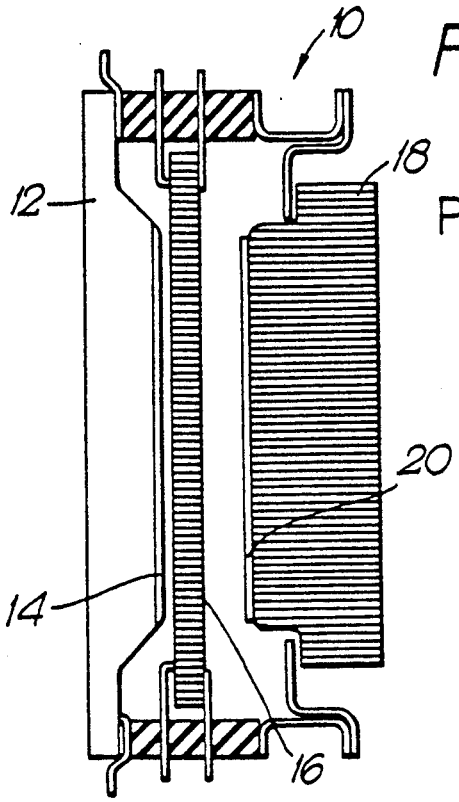
Fig.1. PRIOR ART
FIG. 1 is a cross-sectional view of a prior art image intensifier device.

FIG. 1 shows a prior art image intensifier tube 10 having an input window 12 which may be either glass or fiber optic, a photoemissive wafer 14 bonded to the window 12, a microchannel plate 16 and an output window 18. The output window has a phosphor screen 20 positioned at a surface of the output window adjacent the microchannel plate 16. The output window 18 is a fiber optic element. While the fiber optic window allows images to be transferred from its input side to its output side with very low attenuation, the performance of the window suffers from a relatively low open area ratio.

Figure 2:
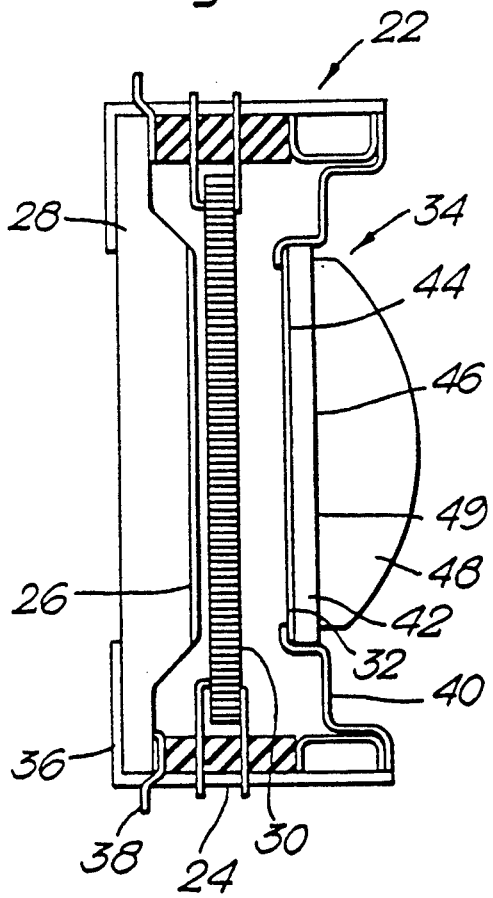
FIG. 2 is a cross-sectional view of the image intensifier device of the present invention.

FIG. 2 shows an image intensifier tube 22 of the present invention. The tube 22 can be seen to comprise three basic components: a photoemissive wafer 26 coated on an input window or faceplate 28 which functions as a cathode; a microchannel plate (MCP) 30 and an anode including a phosphor screen 32 deposited on an output window 34 which functions as an anode. The components are positioned in a housing 24. Power is supplied to the photoemissive wafer 26, the MCP 30 and the phosphor screen 32 by means either integral with or external to the housing 24. The input window 28 is normally sealed within the housing 24 and is surrounded by a peripheral flange 36. Members 38 support the input window 28 in the housing 24. A retainer ring 40 seals the end of the tube 22 and supports the output window in the housing 24. The microchannel plate 30 is formed of a glass material which possesses a secondary emissive property and conductive characteristics.

The faceplate 28 receives and transmits light. Light rays penetrate the faceplate 28 and are directed to the photoemissive wafer 26 which transforms the photons of light into electrons. The electrons are transmitted to the MCP 30 which operates to multiply the number of electrons, all in accordance with known principles. The usual photoemissive wafer is a suitable gallium arsenide (GaAs) device, but other suitable materials can be used.

The microchannel plate 30 is mounted in the tube 22 with both its input and output faces parallel to the photoemissive wafer 26 and the phosphor screen 32, respectively.

In operation, a radiation image impinging on the photocathode causes the emission of electrons which are attracted to the microchannel plate which is maintained at a higher positive potential than the photocathode. Each electron impinging on the MCP 30 results in the emission of a number of secondary electrons which in turn causes the emission of more secondary electrons. The electron gain or multiplication within the MCP 30 is controlled primarily by the potential difference applied across input and output surfaces of the MCP 30. The electrons emanating from MCP 30 and containing the input radiation image information impinge on phosphor screen 32 causing the screen to fluoresce and reproduce the input image.

It has been found that making the output window into a converging or diverging lens element results in an improved output image having greater optical resolution and image quality at lower cost.

FIG. 2 shows an embodiment of the invention in which the output window 34 has two sections. One section is a flat (plano) glass element 42. The glass element 42 has a input surface 44 which is positioned adjacent the MCP 30 and an output surface 46. The glass of the element may be any high quality optical glass.

The second section of the output window 34 is a plano-convex lens element 48. The lens element 48 is joined at its plano surface 49 to the surface 46 of the glass element 42. The phosphor screen 32 is positioned on the glass element at surface 44. Lens element 48 may be either plano-convex or plano-concave, with a spherical or aspherical curved surface.

Figure 3:
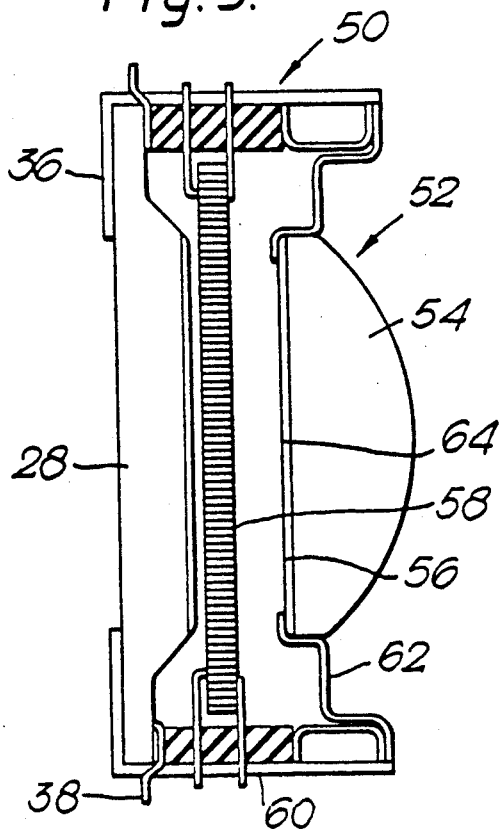
FIG. 3 is a cross-sectional view of an alternate embodiment of the image intensifier device.

FIG. 3 illustrates an alternate embodiment of the invention in which an output window is a single optical element. An image intensifier tube 50 has the same structure as that shown in FIG. 2 except that the output window 52 is a lens element 54 having a plano-convex configuration. The lens element 54 is positioned so that its planar surface 56 is adjacent an MCP 58. The element 54 is retained in a housing 60 by a retaining ring 62. A phosphor screen 64 is positioned on the planar surface 56.

The lens elements 48, 54 are formed of any suitable optical material including glass and plastic.

While the lens elements 48 and 54 are shown as positive (or converging) lens elements, negative (or diverging) lens elements can also be used. The lens elements may have either spherical or aspherical configurations. Usable lens elements include Gradient Index (GRIN) lenses.

Two methods of forming the image intensifier tubes of the present invention are described below. One of the methods is performed at the time the finished tube is assembled in the image intensifier device and will be described with reference to FIG. 2. By using this method, no significant changes are necessary to standard tube formation processes and tooling.

The second method is performed at the time the tube is constructed and will be described with reference to FIG. 3. In this method, no additional process steps are necessary in the assembling of the finished tube into the image intensifier device.

The structure of FIG. 2 is formed in the following manner. The photoemissive wafer 26 is formed on the faceplate 28 to constitute the photocathode. The phosphor screen 32 is deposited on the surface 44 of the glass element 42 to form the anode. The anode is secured in the retainer ring 40. The photocathode, microchannel plate 30 and anode are placed into the housing 24 and the housing is filled with a potting compound. The retainer ring 40 is then placed on the end of the tube to seal the housing. The fabrication of the tube is then complete. The tube fabrication steps are performed in accordance with known procedures.

Prior to insertion of the tube into the image intensifier device, the lens element 48 is bonded to the surface 46 of the plano glass element 42. This is accomplished by applying an optical adhesive to the surface 46 and pressing the lens element 48 in contact therewith and allowing sufficient time for curing of the adhesive.

Other adhesives such as UV curable adhesives and other method of joining the glass and lens elements are encompassed within this invention.

The bonding step recited above may be eliminated by using the lens element 54 of FIG. 3. In this method, the lens element 54 is secured in the retainer ring 62 so that the surface 56 will be adjacent MCP 58 when the ring is in position in the tube.

While use of the lens element as an output window has been described herein, it is within the scope of this invention to use a lens element as a faceplate or input window.

This invention has many applications in the video display field, particularly for small CRT type displays used in military and commercial devices. These devices also include thermal imaging devices, video cameras and similar systems.

While I have described above the principles of my invention in connection with specific apparatus, it is to be clearly understood that this description is made only by way of example and not as a limitation to the scope of my invention as set forth in the objects thereof and in the accompanying claims.

What is claimed is:

1. An image intensifier device comprising:

an input window formed of optical material and having a planar light receiving surface and an opposed planar light transmitting surface;

photoemissive means on said light transmitting surface for emitting electrons in response to light received at said photoemissive means;

amplifying means positioned adjacent said photoemissive means for amplifying the number of electrons emitted from said photoemissive means;

converting means positioned adjacent said amplifying means for converting the energy from said amplified electrons to light to form an image at an output screen thereof; and an output element for outputting the image from said converting means having means for preventing refections of the image between said output element and said planar light transmitting surface of said input window in the form of a flat plano glass element having an input surface positioned adjacent the output screen of said converting means and an output surface in parallel therewith, and a plano-curved lens element having a planar first surface in parallel with said planar light transmitting surface of said input window and being joined to the output surface of said flat plano glass element for receiving the image from said converting means and a curved second surface for transmitting the image therefrom without such reflections.

2. The device of claim 1 wherein said amplifying means is a microchannel plate.

3. The device of claim 1 wherein said converting means is a layer of phosphor material.

4. The device of claim 1 wherein said lens element is a plano-convex lens.

5. The device of claim 1 wherein said lens element is a plano-concave lens.

6. The device of claim 1 wherein said lens element has a spheric curved surface.

7. The device of claim 1 wherein said lens element has an aspheric curved surface.

* * * * *